United States Patent [19]

Stansell

[11] 3,993,023

[45] Nov. 23, 1976

[54] COATED FILAMENT WOUND INK APPLICATOR ROLL

[75] Inventor: Stanley M. Stansell, Columbus, Ohio

[73] Assignee: Xerox Corporation, Stamford, Conn.

[22] Filed: Dec. 5, 1975

[21] Appl. No.: 638,113

[52] U.S. Cl. ..... 118/661; 118/DIG. 23

[51] Int. Cl.[2] ..... G03G 13/00

[58] Field of Search ..... 427/21; 355/3 DD; 118/123, 126, 212, DIG. 15, DIG. 23, 637

[56] References Cited

UNITED STATES PATENTS

| | | | |
|---|---|---|---|
| 3,233,587 | 2/1966 | Morton | 118/637 |
| 3,245,381 | 4/1966 | Brenneisen et al. | 118/637 |
| 3,249,088 | 5/1966 | Ostensen | 118/637 |
| 3,292,572 | 12/1966 | Brenneisen et al. | 118/DIG. 23 |
| 3,500,793 | 3/1970 | Bartusek | 118/637 |
| 3,672,326 | 6/1972 | Schulze | 118/DIG. 23 |
| 3,905,332 | 9/1975 | Sawada et al. | 118/637 |

*Primary Examiner*—Henry S. Jaudon

[57] ABSTRACT

A reproduction system is described having an approved ink applicator arrangement. The reproduction system includes a means for establishing latent electrostatic images on a photoreceptive surface, a means for developing said latent electrostatic image by applying a polar ink to imaged areas of the surface, said developing means having an ink applicator body which is positioned adjacent said photoreceptive surface for transferring ink from said applicator body to said photoreceptive surface, said applicator body having an array of lands and depressions formed on a surface thereof, including superficial grooves being arranged substantially perpendicular to the revolution axis of the developer roller, said grooves being formed by the winding of synthetic resin filament about said cylindrical roll; said synthetic resin filament having been coated with an adhesive solution containing formic acid.

8 Claims, 2 Drawing Figures

COATED FILAMENT WOUND INK APPLICATOR ROLL

BACKGROUND OF THE INVENTION

This invention relates to ink applicator arrangements. The invention relates more particularly to an improved means for applying developer ink to an imaged area in a reproduction system.

In various reproduction and copying systems, it is desirable to apply a developer ink to an image or record medium. More particularly, in one form of electrostatic copying process, a latent image is established electrostatically on an image retention surface with a liquid developing material. The developing material adheres to the surface and conforms to the image. The image is transferred to a record medium for recording, or alternatively, the image retention surface may itself comprise a record medium.

In one image development process sometimes termed polar liquid development, a developer ink is delivered to the image retention surface by a dispensing body. The liquid ink transfers from the dispensing body to the retention surface by virtue of electrostatic forces established by charged areas on the image retention surface. The dispensing body generally comprises a roller having a surface which contacts the image retention surface and which includes an array of lands and grooves. The dispensing body is inked so as to provide a supply of ink which is contained in the grooves of the dispensing body. When the surface of the dispensing body is brought into contact with the surface bearing latent electrostatic image, the liquid development ink transfers from the grooves to the image retention surface by virtue of electrostatic forces exerted on the polar ink.

It has been found that it is particularly advantageous to apply a developer liquid in an electrophotographic process by means of a developing roller consisting of a cylindrical member which has been provided with superficial parallel or thread-like grooves whereby the grooves are arranged substantially perpendicular to the axis of rotation of the development roller. This type of applicator is made by winding an adhesive-coated synthetic resin monofilament under carefully controlled conditions at a predetermined pitch onto a cylindrical rubber substrate. The substrate generally consists of a steel mandrel covered with a layer of conductive elastomeric material. The concept behind such a filament-wound applicator is that the hard filaments can be individually displaced into a soft rubber roll thereby forming a uniform set of lands for the applicator.

In the manufacture of filament-wound applicator rolls for use in liquid development xerography, several problem areas have been identified. One is the need for adequate bonding of a synthetic resin filament such as nylon to the conductive elastomeric substrate during the winding process. Yet another is the proper indexing of the filament thread along the cylindrical roll so that uniform peaks and valleys occur across the developer cylinder. The application of adhesive to the filament just prior to winding to secure the material to the mandrel has been attempted with mixed results. In some cases the coating is not sufficiently bonded to the resin filament so that undesirable flaking occurs. Also application of abundant adhesive just prior to winding causes the adhesive to fill the valleys of the roll thereby also coating the conductive elastomeric material, the conductivity of which is critical to polar ink development. There is a serious need to develop an adhesive coating material which upon application will not coat the conductive elastomeric material in the winding valleys and also does not ultimately flake.

SUMMARY OF THE PRESENT INVENTION

The present invention relates to the use of a thermosetting adhesive composition which is utilized to coat the synthetic resin filaments utilized in the instant developer rolls. Specifically, it has been found that adhesive compositions containing certain amounts of formic acid give improved adhesion of polyamide filament to the conductive rubber roll. It has been further found that nylon filament coated by the formic acid formulations of the present invention have improved tenacity on the polyamide filament because of the solvent action of the formic acid with the nylon. Therefore, the formic acid formulations when applied wet to the filament just prior to winding on the conductive roll adhere firmly to the filament and does not flow into the valley created by the adjacent winding. When dried the coating creates a firm bond with the filament and does not readily flake upon abrasion.

In summary, the present invention relates to a development apparatus for developing electrostatic images comprising a means for establishing latent electrostatic images on a photoreceptive surface, a means for developing said latent electrostatic image by applying a polar ink to imaged areas of the surface, said developing means having an ink applicator body which is positioned adjacent said photoreceptive surface for transferring ink from said applicator body to said photoreceptive surface, said applicator body having an array of lands and depressions formed on a surface thereof, including superficial grooves being arranged substantially perpendicular to the revolution axis of the developer roller, said grooves being formed by the winding of synthetic resin filament about said cylindrical roll; said synthetic resin filament having been coated with an adhesive solution containing formic acid prior to winding.

DETAILED DESCRIPTION OF THE DRAWINGS

Figure 1:
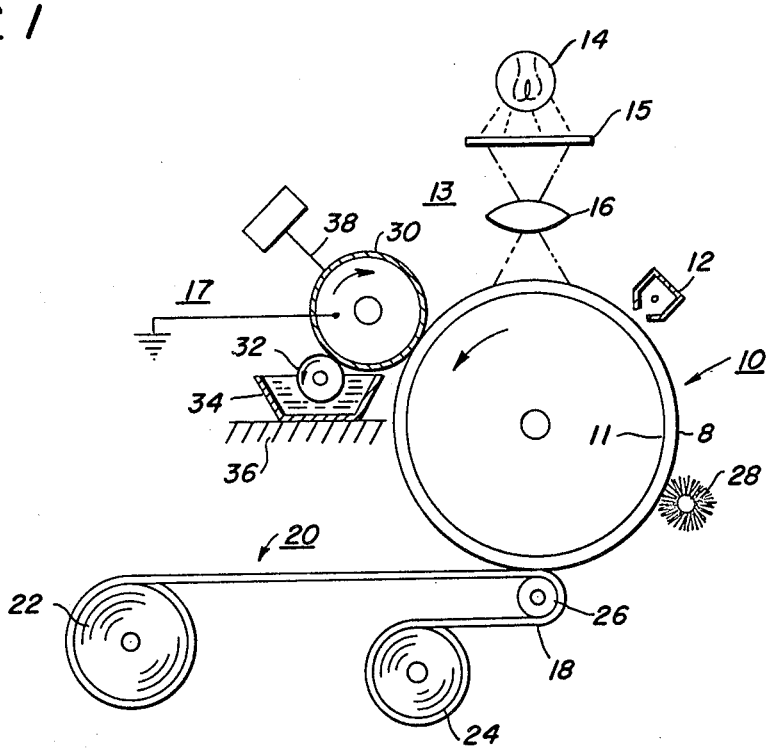
FIG. 1 is a schematic view of one embodiment of the development apparatus of the present invention.

Referring now to FIG. 1, an electrophotographic copying apparatus employing liquid development includes a rotatably mounted drum having a photoconductive surface comprising, for example, a layer 10 of vitreous or amorphous selenium positioned on an outer surface 11 of the drum. The drum is continuously rotated in a counterclockwise direction past a charging station 12 which establishes a uniform electrostatic charge on the image retention surface. The charging electrode 12 comprises, for example, a high voltage corona discharge electrode adapted to supply ions or charges to the image retention surface. The uniformly charged imaged retention surface is rotated to an imaging station 13. There is positioned at the imaging station a means for projecting an image onto the charged surface for forming latent electrostatic image conforming to the original image. This means includes a projection system including a lamp 14, a photographic transparency 15 bearing an image which is to be reproduced, and a lens 16 for focusing the image on the uniformly charged surface 10. The latent electrostatic image, which is thus formed, is rotated by the drum to a development station referenced generally as 17. At the development station, which is described in greater detail hereinafter, the latent electrostatic image is developed and is then transported by the drum to an image transfer station 18 at which location the image is transferred from the drum to a suitable transfer web 20. The web 20 comprises, for example, a web of liquid developer receptive paper or the like which is fed from a supply roller 22 to a take-up roller 24 and passes between the drum and a transfer roll 26. After image transfer, the image retention surface is rotated past a cleaning station designated as generally 28, where residual developer material, if any, is removed by a rotating brush from the drum surface in order to prepare the drum for recycling through the above-described operational stations.

Although a photoreceptive surface is shown in FIG. 1 to be formed on the surface 10 of the drum, other forms of photoreceptive surfaces known in the art can be employed. For example, a web or sheets of zinc oxide recording media can be transported by the drum 11 to the various stations and can replace the use of the transfer web 20. Alternatively, the web 20 can be replaced by a sheet collection station.

A development means is positioned at the development station 17 for providing liquid development to latent electrostatic image on the image retention surface 10. The development means includes a liquid developer applicator member comprising a rotating drum 30, an inking roller 32 and a reservoir 34 containing developer ink 36. The drum 30, which is described in greater detail hereinafter, has deposited on its surface a film of ink for transport to the rotating drum 8 and for application to the image retention surface 10. The development ink 36 is withdrawn from the reservoir 34 by the inking roller 32, which is partially submerged in the ink, and is conveyed and applied to the ink applicator drum 30. An ink applicator docotoring arrangement 38 is positioned for contacting the surface of the rotating developer dispensing drum 30 which is the filament-wound developer roll of the instant invention. The doctoring means is provided for removing excess ink from the filament-wound roll 30 after loading of the applicator and prior to transfer of ink to the image retention surface.

Figure 2:
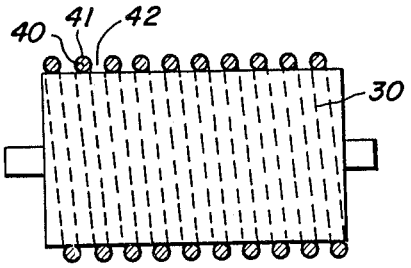
FIG. 2 demonstrates an embodiment of the instant development applicator roller.

The surface of the filament-wound cylindrical roll applicator member 30 of FIG. 1 is shown in greater detail in FIG. 2. Therefore, as is shown, the roller is conductive elastomeric cylindrical member 30 onto which is wound a synthetic resin filament material 40, such as nylon, having adhesive coated thereon 41, said threaded filament having a diameter of between 1.1 to 2.0 mils. The single windings of the filament should be arranged side by side. The filament may comprise any synthetic resin material which can be spun into wire-like thread. As can be further seen from the figure, the filament is pitched at an angle. Preferred within the purview of the present invention are threads having a thread pitch of from about 2 to 5 filament diameters and a depth substantially equal to the filament diameter.

FIG. 2 additionally indicates the valleys between the monofilament windings. As can be seen, the conductive elastomeric material on the mandrel is exposed in the valleys 42. It is critical in the application of polar ink to a photoconductive surface that the polar ink in the valleys of the applicator interface with the conductive elastomeric material, neoprene or polyurethane. Therefore, the coating 41 on the filaments when applied before winding must adhere to the fiber in such a manner as to cause affixation of the filament to the elastomeric roll but not flow into the valleys between strands so as to cause undesirable coating of the elastomeric roll in the valleys which will ultimately inhibit development. As can be seen the coating 41 is restricted to the strands of filament thereby enabling the valleys to expose the conductive elastomeric to polar ink to be deposited therein. It should be apparent that the spacing of the filaments as well as the coating thereon have been exaggerated for purposes of demonstration and explanation.

As mentioned above, the monofilament must be wound about a conductive elastomeric material which sits on the mandrel. Included within this type of material are polyurethane and neoprene materials. Typically, a blank rubber blanket prior to winding should be straight, should show no surface waviness, should be concentric, and have a surface finish with no surface defects. The rubber material itself must also possess the physical properties of hardness of about 60 to 70 Shore-A-Durometer, volume resistivity of up to $10^5$ ohm.cm or less, compression set of up to 5% or less, and there should be no visible carbon black platelets on the roll surface after grinding to the finished dimensions.

Generally in the winding of a roll, a nylon monofilament is unwound from a light bobbin and passed through a cleaning bath of methyethyl ketone. Tension is applied to the filament by means of a magnetic hysteresis tensioner. The tension measured at a point before the filament enters the guiding orifice should be about 3 to 4 grams and the total tension after passing through the adhesive bath and die should be about 5 to 6 grams. At this level of tension the extension of 15 denier nylon 6 approximates to 1 to 2% but the elastic recovery is 100%. This results in some compression of the relatively soft polyurethane substrate but higher filament tension produces excessive compression of the substrate and unacceptable inaccuracies in filament spacing uniformity. The accuracy of filament spacing will depend on (a) filament wonder and (b) the operational accuracy of the lathe accomplishing the spiral winding.

As discussed above, the instant invention relates to the use of formic acid in the adhesive composition to accomplish a more firmly wound and more durable developer roll. Within the purview of the instant invention, the following group of thermosetting adhesives may be employed (percentages by weight):

| | |
|---|---|
| SAMPLE I | |
| Polyvinyl Formal Resin (Formvar - General Electric Corp.) | 4.5 % |
| Phenolic Resin (Varcum 29-112) Reichold Chemicals Inc. | 22.5 % |
| Formic Acid (added as a 90 % aqueous solution) | 40.5 % |
| Shellacol | 10.8 % |
| Toluene | 10.8 % |
| 1,4-Dioxane | 10.8 % |
| SAMPLE II | |
| Polyvinyl Formal Resin (Formvar - General Electric Corp.) | 6.5 % |
| Phenolic Resin (Varcum 29-112 Reichold Chemicals Inc. | 19.5 % |
| Formic Acid (added as a 90 % aqueous solution) | 39.0 % |
| Shellacol | 11.7 % |

-continued

| | |
|---|---|
| Toluene | 11.7 % |
| 1,4-Dioxane | 11.7 % |

A moderately uniform coating of these two adhesive compositions is applied to the filament by drawing it through a bath of the respective sample, which also acts as a secondary tensioning device, and an orifice in the form of a drilled jewel wire drawing die. The die both doctors the filament to remove surplus adhesive and guides it onto the roller surface. Because of the use of formic acid in the adhesive, the polyamide monofilament (nylon) is softened and thereby the coating is accommodated more uniformly throughout the whole fiber. Each of the samples were found to be rheologically suitable for use in conjunction with the die in that no excessive tension was applied to the filament prior to its application on the roll. Test results with these formulations were particularly outstanding. Destructive tests (scraping, abrading, flexing) failed to separate the coating from the nylon. Additionally, no boundary between coating and substrate could be observed microscopically. Apparently, the solvent action of the formic acid on the nylon produced an intermingling of nylon and coating with a resultant gradual transition in properties. In summary, these coatings demonstrated outstanding adhesion to nylon substrates; that is the coatings were very tough and solvent resistant.

Within the purview of the present invention, it is the formic acid which renders the significant results outlined above. The amount of formic acid compound necessary to accomplish these optimum results has been found to be from about 30 to 40% by weight of a 90% aqueous formic acid. Therefore, the percentage range will obviously vary when using formic acid of different concentrations. However, all concentrations of formic acid are within the purview of the present invention. The use of the formic acid has been found to extend the life of the developer roll inasmuch as its solvent effect on the polyamide fiber (nylon) enables thorough penetration of the adhesive coating which ultimately protects the fiber thereby further increasing its durability.

The formic acid adhesive treated filament-wound rolls outlined above can be used in the polar liquid ink development of electrostatic image by the processes outlined above. The liquid development system according to the present invention can be practiced with all known photoconductive layers, for example, layers of selenium, sulphur and organic photoconductors or with those electrophotographic layers which contain the photoconductive substance dispersed in an insulating binder.

The developer liquid within the purview of the present invention comprises suspension of finely divided particles in a dielectric liquid. The liquid itself must be sufficiently insulating to prevent dissipation of the electrostatic charge pattern on member 100. This generally requires a volume resistivity in the order $10^{13}$ to $10^{14}$ ohm-centimeters or greater. Suitable liquids include among others normal heptane, normal hexane, petroleum ether and various commercial petroleum solvents having volatility in the kerosene to gasoline range. Suitable liquids of this latter type include Sohio Odorless Solvent No. 3440, available from the Standard Oil Company of Ohio; commercial kerosene; Shell 140 solvent and Shell 8230 insecticide base, both available from the Shell Chemical Corporation; and Soltrol 130, available from the Phillips Petroleum Company. Where non-flammable liquids are desired, use can be made of carbon tetrachloride, tetrachloroethylene, trichloroethylene, and trichloro-trifluoroethane. Various other liquids having the necessary resistivity can also be used as the liquid component of the developer liquid. The particles used in the developer liquid may also comprise various types. They may, for example, comprise finely divided pigmented resin particles of the vinyl, acrylic or other types, finely divided dry pigments, fine particles of dyes insoluble in the dielectric liquid employed, or artists' oil pigments dispersed in the liquid.

While the invention has been described with reference to specific embodiments, it will be understood by those skilled in the art that various further modifications and alternative structures and combinations thereof may be made and equivalent substituted without departing from the true spirit and scope of the instant invention. It is to be further understood that the cylindrical roll upon which the filament is wound generally comprises a conductive metallic mandrel covered with a layer of conductive elastomeric material. Additionally to be understood is that neoprene is polychloroprene $(C_4H_5cl)n$.

What is claimed is:

1. An electrostatic reproduction system comprising a means for establishing latent electrostatic images on a photoreceptive surface, a means for developing said latent electrostatic image by applying a polar ink to imaged areas of the surface, said developing means having an ink applicator body which is positioned adjacent said photoreceptive surface for transferring ink from said applicator body to said photoreceptive surface, said applicator body having an array of lands and depressions formed on a surface thereof, including superficial grooves being arranged substantially perpendicular to the revolution axis of the developer roller, said grooves being formed by the winding of synthetic resin filament about said cylindrical roll; said synthetic resin filament having been coated with an adhesive solution containing a formic acid prior to winding.

2. The system of claim 1 wherein the cylindrical roll comprises a conductive elastomeric material.

3. The system of claim 2 wherein the conductive elastomeric material is neoprene or polyurethane.

4. The system of claim 1 wherein the synthetic resin fiber filament is a polyamide.

5. The system of claim 1 wherein the percentage of formic acid in the adhesive solution is from about 30 to 40% by weight based on a 90% aqueous formic acid solution.

6. The system of claim 4 wherein the wound filament has a diameter of between about 1.1 to 2.0 mils.

7. The system of claim 6 wherein the filament threads have a thread pitch of from about 2 to 5 filament diameters and a depth substantially equal to the filament diameter.

8. The system of claim 1 wherein the adhesive composition additionally comprises a polyvinyl formal resin, a phenolic resin, and organic solvents.

* * * * *